United States Patent [19]

Hed

[11] Patent Number: 4,996,508

[45] Date of Patent: Feb. 26, 1991

[54] TEMPORAL AND SPATIAL CONTROL OF FIELD TOPOLOGIES IN SOLENOIDS

[75] Inventor: Aharon Z. Hed, Nashua, N.H.

[73] Assignee: International Superconductor Corp., Riverdale, N.Y.

[21] Appl. No.: 334,583

[22] Filed: Mar. 21, 1989

[51] Int. Cl.[5] ..... H01F 7/22

[52] U.S. Cl. ..... 335/216; 338/325

[58] Field of Search ..... 335/216, 299; 174/125.1; 505/1

[56] References Cited

U.S. PATENT DOCUMENTS

| | | | |
|---|---|---|---|
| 4,528,532 | 7/1985 | Keim | 335/216 |
| 4,635,015 | 1/1987 | Franksen | 335/216 |
| 4,868,707 | 9/1989 | Takechi | 335/216 X |
| 4,870,379 | 9/1989 | Aihara et al. | 335/216 X |

FOREIGN PATENT DOCUMENTS

| | | | |
|---|---|---|---|
| 0306287 | 3/1989 | Japan | 335/216 |
| 0160065 | 6/1989 | Japan | 335/216 |

*Primary Examiner*—George Harris
*Attorney, Agent, or Firm*—Herbert Dubno

[57] ABSTRACT

Devices and technique using specially configured switchable superconducting elements to achieve temporal and spatial modulation of magnetic fields created in the hollow of solenoids are provided.

19 Claims, 5 Drawing Sheets

TEMPORAL AND SPATIAL CONTROL OF FIELD TOPOLOGIES IN SOLENOIDS

Cross reference to related Applications. This Application relates to my co-pending Applications: Ser. No. #07/281,832 filed on 8 December 1988 entitled "Diamagnetic Colloids Conntaining" Superconducting Particles"; Ser. No. #07/314,426 filed on 22 Feb 1989 entitled "Electronic Modulation of Magnetic Fields"; Ser. No. #07/314,427 filed on 22 Feb. 1989 entitled "Switchable Superconducting Elements and Pixels Arrays"; and Ser. No. #334,584 filed on 21 March 1989 entitled "Magnetic Flux Concentrators and Diffusers".

Disclosure Documents #200258, received at the Office of the Commissioner of Patents and Trademarks on Aug. 30, 1988.

FIELD OF THE INVENTION

My present invention is in the field of magnetic field modulation by switchable superconducting elements interposed in the fields.

BACKGROUND OF THE INVENTION

In the prior art, for a given solenoid configuration, one could modify the strength of the magnetic field by changing the current in the solenoid, however, the distribution and topology of the fields thus created remained essentially constant. A variant of the single solenoid often used, involves a number of independent solenoids wound on a single core, and adjacent to each other. Variations in magnetic field morphology can be achieved by the judicious choice of combinations of the solenoids powered and control of the current passing through each independent solenoid. This approach while feasible is cumbersome and with limited freedom of possible topologies. Furthermore, each desired configuration requires the physical implementation of a specific set of solenoids, thus strongly limiting the versatility of this method.

In my co-pending applications entitled "Electronic Modulation of Magnetic Fields" and "Switchable Superconducting Elements and Pixels Arrays", the general principles of using switchable superconducting elements to obtain modulation of magnetic fields in the vicinity of said elements was described. In yet another co-pending application entitled "Magnetic Flux Concentrators and Diffusers", we described how the magnetic field created between two poles of a magnet can be modified and controlled by introducing switchable superconducting elements of unique morphology. The present invention provides for the modulation of axial magnetic fields that are generated within solenoids. This is achieved by switching in and out of the superconducting state superconducting elements of a special design, specifically annuli that are concentric with the solenoid The result is a variety of configurations in which the normally axial magnetic field of a solenoid can be modulated temporally as well as spatially.

We believe these devices will find applications in the movement and position control of diamagnetic colloids (see my co-pending application entitled "Diamagnetic Colloids Containing Superconducting Particles"), particularly in unique drug delivery systems, new analytical instruments and magnetic separation systems.

The devices described may also find uses in a variety of diagnostic imaging systems, non destructive testing instruments and material characterization systems.

A variant of the devices described herein can be used as the magnetic field wiggler in a free electron laser (FEL) device. Unlike the current technology that requires the physical modification of the geometry of the fixed magnets in such wigglers, the present devices can provide for the electronic modification of the magnetic field configuration thus imparting an element of flexibility in FEL design heretofore not available.

As will be evident from the design of the present invention, the fact that the superconducting elements may have to be cooled to cryogenic temperatures does not prevent ambient operation of the usable space where the magnetic field is modulated. This, since the core containing the superconducting annuli responsible can be isolated thermally from the solenoid's hollow as well as from the solenoid's coil. While such cryogenic applications would be most cost effective in large industrial installations, where the cost of cryogenics installation is relatively small to the total cost of the system, smaller instrumentation with portable liquid nitrogen can employ the subject of this invention as well.

OBJECTS OF THE INVENTION

It is an object of my invention to provide unique solenoids in which the axial magnetic field generated by the windings in the hollow of the solenoid can be modulated spatially electronically. It is another object of my invention to provide magnetic field within said solenoid that can be modulated spatially and temporally.

SUMMARY OF THE INVENTION

These objects are attained in accordance with the invention in that one or more annuli of a switchable superconductor concentric with the solenoid winding and enclosed within the windings are provided By switching one or more of said annuli in and out of the superconducting state, modulation of the magnetic field within the solenoid is obtained. This modulation occurs both in the space between the annuli and the windings, and in the space enclosed by the annuli.

BRIEF DESCRIPTION OF THE DRAWINGS

The above objects, features and advantages of my invention will become more readily apparent from the following description, reference being made to the accompanying drawings.

DESCRIPTION OF THE INVENTION

In the following we will show how sets of specially designed switchable superconducting annuli can be used within the core of a solenoid to modify the magnetic field morphology within the solenoid in manner heretofore not possible.

Figure 1:
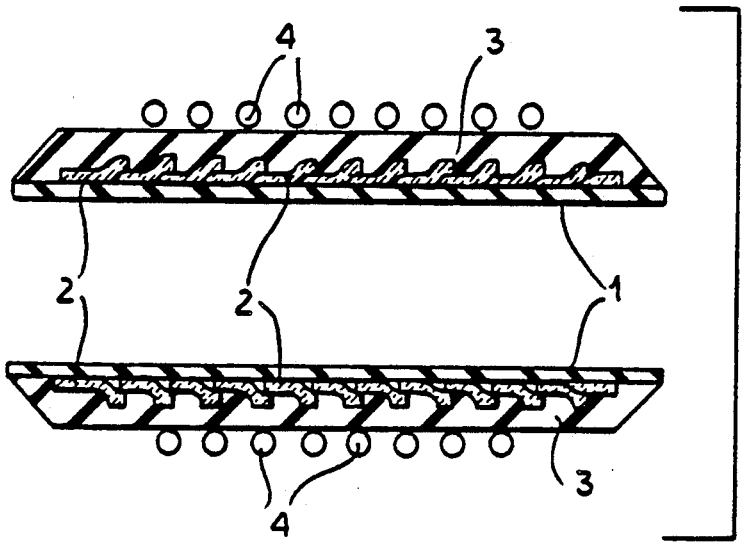
FIG. 1 which is a generalized cross section through a solenoid of the instant invention.

In FIG. 1 we show schematically a cross section through a solenoid designed to obtain spatially and temporally variable magnetic fields.

We start with a solid and insulating core (#1) On this core we deposit overlapping annuli of a superconducting substance (#2) (for methodologies, see for instance my co-pending applications entitled "Electronic Modulation of Magnetic fields). It should be emphasized that the separate annuli are electrically insulated from each other in a manner similar to that described in a co-pending application entitled "Magnetic Field Concentrators And Diffusers". This insulation is not shown in FIG. 1 for simplicity. Also omitted from the figure are pairs of leads connecting the opposing sides of each annulum and allowing the passage of a quenching current through each annulum.

On top of the superconducting annulum (#2) we now deposit a relatively thick layer of insulation (#3), and finally a set of windings (#4) is coiled on the outside of this insulation.

As we explained in the co-pending application entitled "Magnetic Field Concentrators And Diffusers", mentioned above, the annuli need to overlap a little in order to avoid excessive magnetic field leakage between the annuli. It should be emphasized however that for most applications except the most demanding, this overlapping is probably not necessary thus simplifying the construction of the devices.

Before we explain the operation of the proposed devices, we describe another embodiment that will serve for the same end but is usually simpler to construct and has as an additional optional feature a hollow space between the superconducting annuli and the external solenoid.

Figure 2:
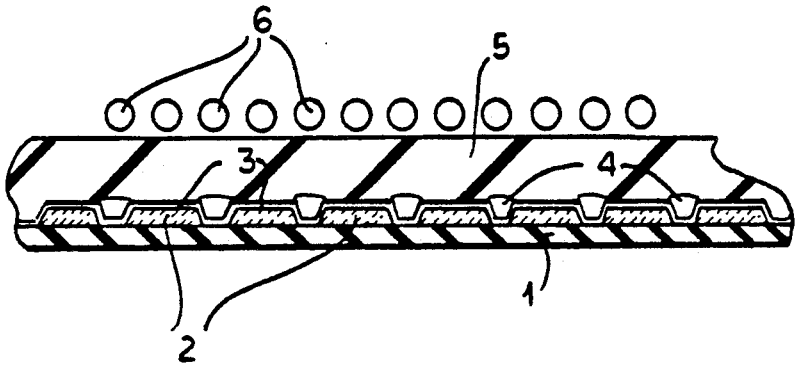
FIG. 2 which is a cross section through an alternative embodiment of the instant invention.

This embodiment is shown in FIG. 2. For the sake of simplicity we show in this figure only a cross section through the cylinder forming the device This cross section is a plane perpendicular to the cylinder's surface and contains the center line of the cylinder. As in FIG. 1, we have a support insulating core (#1), on which we have deposited discrete superconducting annuli (#2), slightly separated from each other (not shown are the switching leads to each annulum) On top of the superconducting annuli we now deposit a thin insulation (#3), and instead of having the superconducting annuli overlap as in FIG. 1, we obtain a similar effect by depositing in the space between the large annuli smaller annuli (also switchable) but as mentioned above, these are optional and should be utilized only under extremely demanding conditions. We now cover this assembly with an insulation (#5), on which the solenoid (#6) is wound. For some applications, one may want the insulation (#5) to be a space in which a secondary medium is treated magnetically, when this is the case, the narrow superconductor annuli should be first insulated or abandoned, and the inner cylindrical assembly can be fastened with appropriate means in an external cylinder, which is also the support for the solenoid coil (#6).

For cryogenic superconductors the hollow serves a space in which circulation of a cryocooling heat exchanging substance occur, this to keep the superconductor at a temperature below its critical temperature.

It should be obvious to persons trained in the art, that other techniques for producing the devices of the instant invention are feasible as well. One such technique can include the consolidation of annuli independently from each other by sintering techniques, followed by their assembly into a structure as described herein. Such a technique would be more suitable for large devices.

Figure 3:
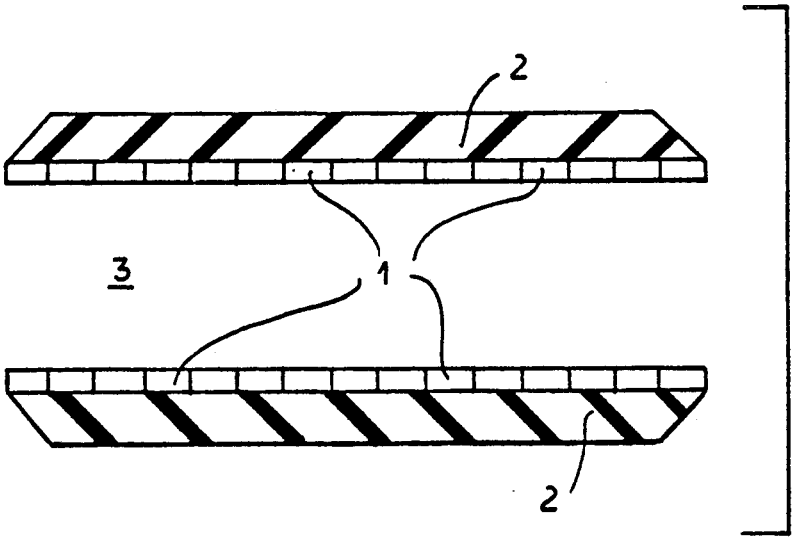
FIG. 3 which is a symbolized description of the instant invention.

In FIG. 3 we show a simplified structure of the device so as to facilitate further discussions. This assembly consists of the individually switchable superconducting annuli (#1), the outer insulation (hollow or not) (#2) and the inner solenoid space (#3). The external solenoid will be assumed to be powered for the following descriptions with a fixed current. It should be self evident that further versatility, particularly as pertaining to resultant field intensities can be gained by controlling the solenoid's current with time.

Figure 4:
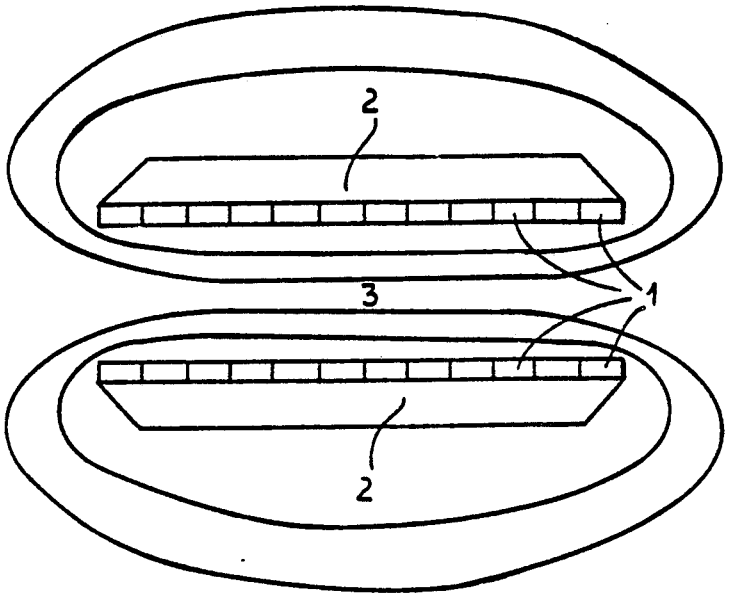
FIG. 4 which shows the magnetic field configuration when all superconducting annuli are quenched into the nonsuperconducting state.

Let us now address ourselves to FIG. 4, in which all the 5 superconducting annuli (#1) are switched to their nonsuperconducting state by means as described in the co- pending applications entitled respectively "Electronic Modulation of Magnetic Fields" and "Magnetic Field Concentrators and Diffusers". Since the superconductor is in the nonsuperconducting state, and thus it is at most a weak paramagnetic material, the field distribution within the hollow (#3) is homogeneous, at least near the middle of the space (#3), and coincides closely to the field generated by a normal solenoid.

Figure 5:
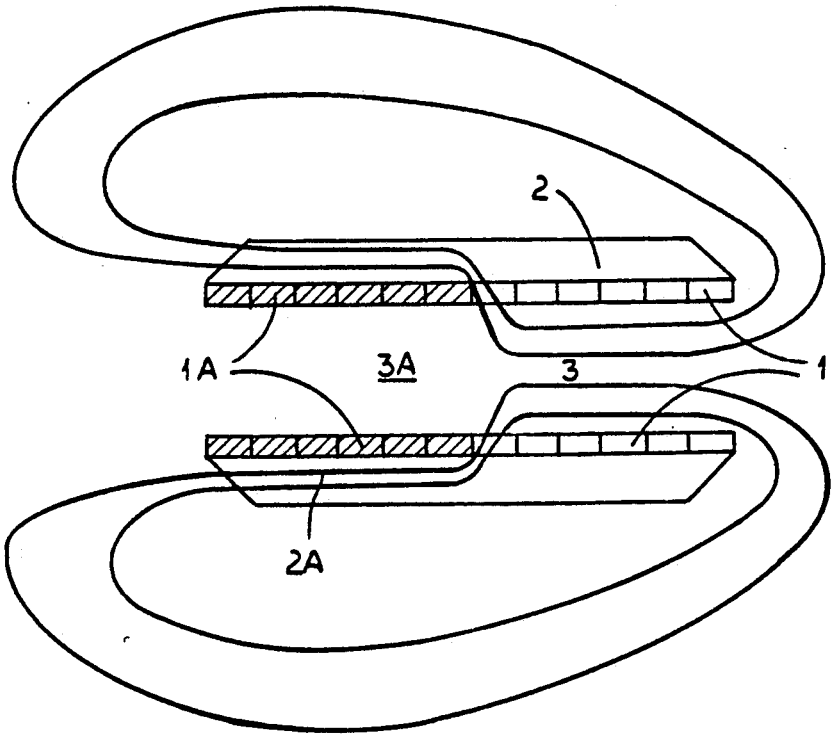
FIG. 5 which shows the magnetic field configuration in the instant invention when part of the superconducting annuli are quenched to the nonsuperconductive state.

If we now let the annuli (#1A), in FIG. 5, in the left part of the device return to the superconducting state, while the annuli (#1) in the right part are still nonsuperconducting, we can see that the field distribution will take a form as depicted by the field lines, whereby the space (#3A) is devoid of a magnetic field and within space (#3) the magnetic field intensity is about as it was (neglecting for the moment transition effects between the switched and unswitched region) when all the superconducting annuli where nonsuperconducting. We should note however a strong magnetic field concentration in the space (#2A) surrounding the now superconducting annuli (#3A). The concentration is proportional to the ratio of the cross section of the solenoid supporting cylinder within the coil and the cross section created between that cylinder and the external (cylindrical) surface of the superconducting annuli. In region (#2), however, the field intensity is essentially as in FIG. 4.

Between region (#3) and (#3A), as well as between (#2) and (#2A) there is a short area of field concentration as well as a strong change in field direction We should also note appropriate changes in the field topology outside of the solenoid, but these changes are less pronounced and of smaller practical use.

It should be mentioned here that depending on the properties of the superconducting annuli, the field topology could be very different if the switching of the annuli is done in the presence of the applied magnetic field from the solenoid, or the switching is done without the external field presence, and then the field is applied The figures in this text assume that the external fields are applied after the superconducting annuli have been configured to be superconducting or not. While the final results may differ if the externally applied field is present during the switching, particularly as they relate to trapped magnetic fluxes, the changes in field morphology are similar in shape, if not in intensity.

Figure 6:
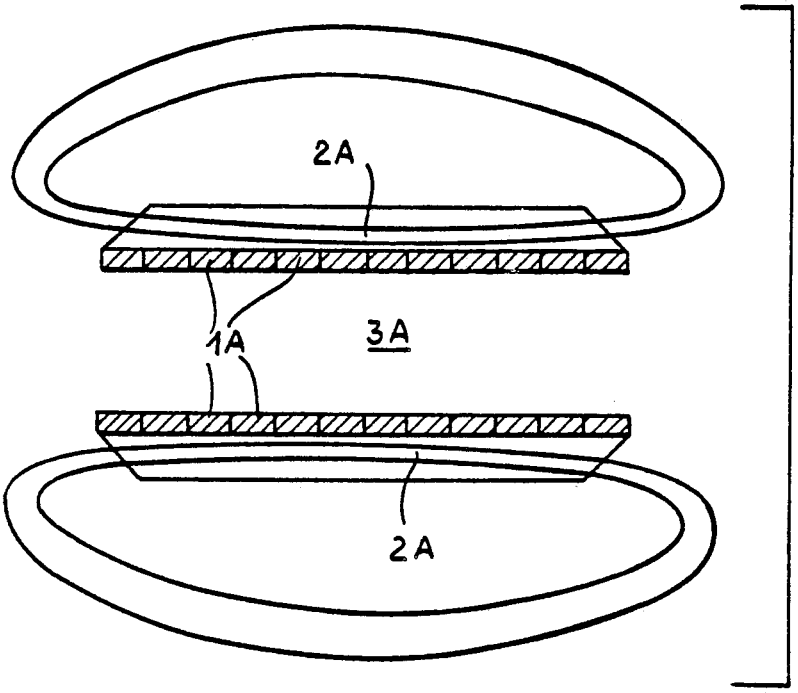
FIG. 6 which shows the magnetic field configuration in the instant invention when all the superconducting annuli are in their superconductive state.

Let us now consider FIG. 6 where all the superconducting annuli (#1A) ,are allowed to return to their superconducting state All the magnetic flux that occupied the combined spaces (#3A) and (#2A) is concentrated between the external surface of the superconductor annuli and the field generating coil, or the space (#2A). The space within the superconducting annuli (#3A) is now practically devoid of any magnetic field flux.

Figure 7:
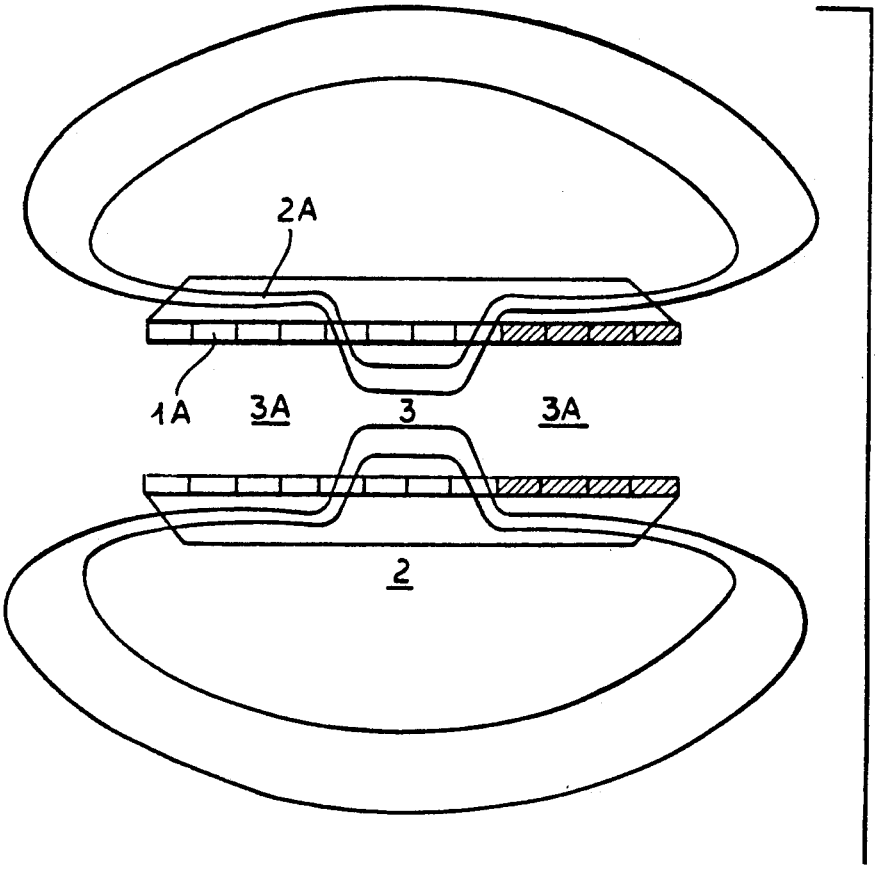
FIG. 7 which shows the magnetic field configuration in the instant invention when one or more of the superconducting annuli in the middle of the solenoid are quenched to the nonsuperconductive state.

In FIG. 7, we show a solenoid configuration where the superconducting annuli at the extremities of the structure (#1A) are in the superconducting state while the middle annuli are in the nonsuperconducting state The resulting field flux is depicted as well, with regions (#3A) at the extremities of the structure within the superconducting annuli devoid of magnetic field flux, and a middle region (#3) with normal magnetic field distribution. The three regions are separated by steep magnetic field gradients. Concentration of the field in the regions (#2A) at the extremities outside the superconducting annuli can be observed as well.

Figure 8:
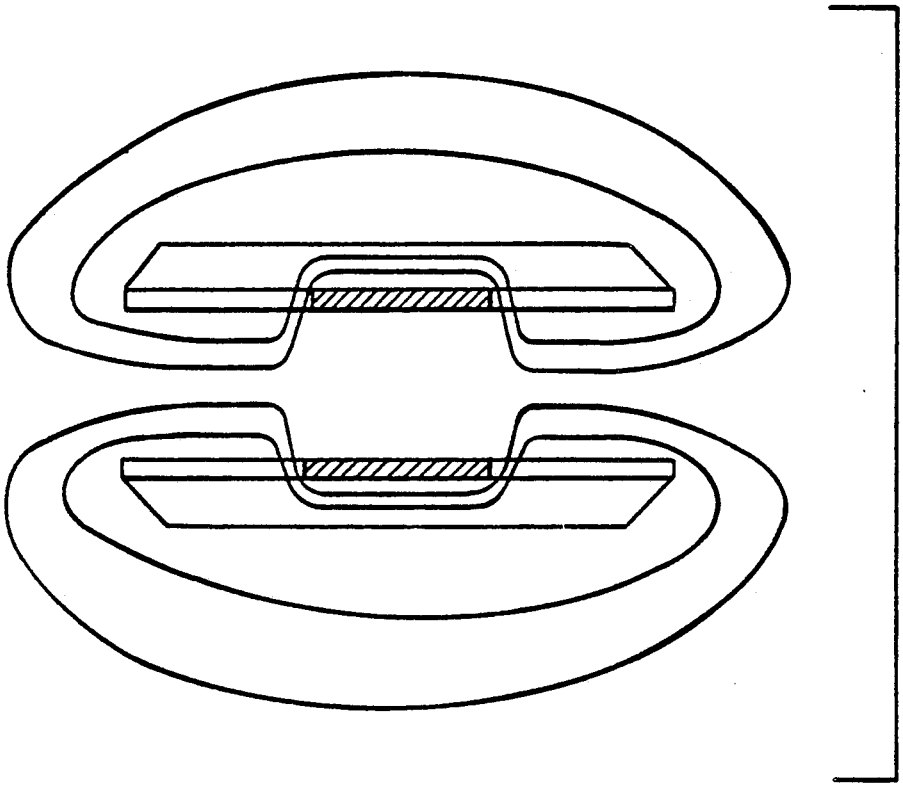
FIG. 8 which shows the magnetic field configuration in the instant invention when one or more of the superconducting annuli are quenched to the nonsuperconductive state at both extremities of the solenoid but the middle section's annuli are superconducting.

The mirror image of FIG. 7 is in FIG. 8 which should now be self explanatory.

Figure 9:
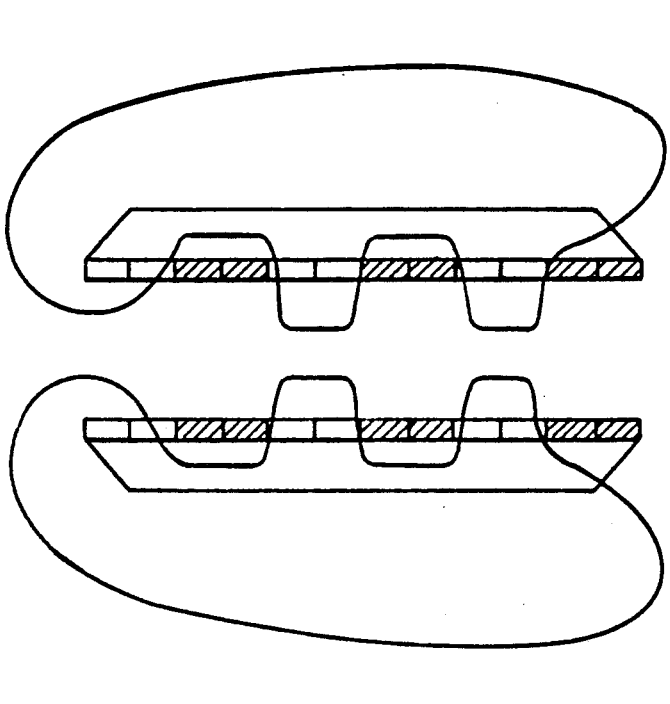
FIG. 9 which shows the magnetic field configuration in the instant invention when consecutive groups of the superconducting annuli are quenched to the nonsuperconductive state and separated by group of annuli that are still in the superconductive state.

Finally, in FIG. 9, we show a device in which the superconducting annuli are divided in consecutive groups that are in the superconducting state and in the nonsuperconducting state, and the field topology associated with this morphology.

Until now we have shown a variety of static configurations of magnetic field possible with the basic solenoid described in general terms in FIGS. 1 to 3. In other words we have provided for the spatial modulation of the magnetic field within a solenoid by the appropriate choice of quenched and unquenched superconducting annuli.

It should be obvious that if one desires a fixed magnetic field with a configuration similar to one of the configurations described herein, or a variant thereof, one can simply exclude the quenched superconductors altogether and use non quenchable annuli spaced as required by the fixed magnetic field required.

Since in principle, we can make the width of the superconducting annuli quite narrow, we can obtain a broad variety of configurations by the judicious choice of combinations of switched and unswitched annuli groupings. It should be remembered, however, that the depth of penetration of the magnetic field between two group of superconducting annuli separated by a space in the nonsuperconducting state is a function of the their relative width, namely, if the nonsuperconducting state annuli total width is very small relative to the superconducting annuli total width, only minimal penetration of the field in the region between these annuli will occur.

One of the simplest application of the family of devices is the creation of a pulsating field in an enclosure by sequentially switching between the states depicted in FIG. 4 and FIG. 6. While a similar device can be obtained by switching the powering solenoid on and off, the advantage of this device is the elimination of the magnetic field within the solenoid. Furthermore, in some applications, the increased field flux concentration of the magnetic field in the space between the outer surface of the annuli and the solenoid can be useful, and this cannot be achieved as easily by classical means.

More important applications are derived from the configurations described in FIG. 5, 7, 8 and 9. To describe these applications, let us denote the individual superconducting annuli with the number 1 to n from left to right. Let us consider first FIG. 5 where the annuli 1 to i are superconducting and the annuli i+1 to n are in the nonsuperconducting state. The field topology is as described in FIG. 5. If we now let the annulus i+1 return to the superconducting state, the topology of the field will be displaced, with minimal morphological change, by the width of an annulum to the right. If such switching is done consecutively from i=1 to i=n, keeping at all times all annuli smaller than i superconducting and all annuli larger than i in the nonsuperconducting state, we will move from a field topology described in FIG. 4 to a field topology described in FIG. 5 through n consecutive topologies characterized by the topology shown in FIG. 5, except that the location of the magnetic field gradient will be moved from the left to the right of the device in a semicontinuous manner.

Similarly, we may want to just move back and forth the gradient of the magnetic field between a position $i<j$ to the position j, leaving a space to the left of i which is always devoid of magnetic field and a space to the right of j always in a fixed magnetic field These methods of activation create devices that are capable of forming temporally and spatially variable magnetic field within the solenoid, in this case in particular, a variety of sweeping magnetic field gradients bounded by high and low (or zero) magnetic field. One can design systems in which the used space is either the hollow of the solenoid, or the space between the external surface of the superconducting annuli and the support structure of the solenoid, or both. Such devices are very impractical in the current art and of great importance in the implementation of magnetic field separation technology, diamagnetic colloids, unique drug delivery systems and possibly, magnetic field dependent imaging and diagnostics.

If we look now at FIG. 7, where the annuli 1 to i and j+1 to n are superconducting while the annuli i+1 to j are in the nonsuperconducting state (assuming $j-i>1$), we can easily see that by incrementing sequentially and simultaneously i and j, we can obtain a moving bolus of a magnetic field terminated with magnetic field gradients and bounded by spaces devoid of magnetic fields. Applying similar sequential and simultaneous switching to the superconducting annuli of the mirror image of FIG. 7, or as described in FIG. 8, will result in creating a moving bolus of space devoid of any magnetic field terminated by magnetic field gradients and bounded by spaces in which high magnetic fields flux are present Finally, we can apply the same principles to very long solenoids, in which consecutive groups of annuli are in the superconducting and nonsuperconducting states, and move in any direction a set of alternating regions that have high magnetic fields and no magnetic fields, separated by appropriate magnetic field gradients (in a manner similar to that described in FIG. 9 for two such sets of regions).

It should be self evident that moving the switched (and unswitched) regions in both the left to right and right to left directions is possible.

It should also be self evident that the principles taught herein can be used to create a temporal change in the magnetic field over displacement that are as large as the whole solenoid, or as small as only one annulus.

It should also be self evident that the devices described herein can be used for controlling the magnetic field over such displacements in a repetitive manner over small displacements as well as over any appropriate fraction of the device described, thus providing for full versatility, within the constraints of the specific geometry, of temporally varying the magnetic field within the two general spaces described in this invention (#2 and #3).

It should be self evident to persons familiar with the art that there are limitations on the intensity of the magnetic fields that can be controlled in the manner described above, set by the refractoriness, or the critical fields of the superconducting substance chosen for the switchable annuli.

The majority of the intended applications require modulation of relatively weak magnetic fields For these applications, and in order to limit the power consumption of the systems, we recommend using materials that have low current density capabilities. Usually, such materials will also have low critical fields, nevertheless, these critical fields will be much higher than the weak fields that need be modulated.

If the requirement to modulate higher magnetic fields arises, the devices described herein can still be designed without the need to use excessive current by the judicious design and minimization of the cross section of the annuli.

When relatively steady state modulation is required, a combination of thermal and current switching may be preferred in order to avoid very high continuous current densities in the switched superconductor. The designer should have the frequency of switching in mind when designing the system in order to accommodate the relaxation times required between the superconducting and nonsuperconducting states.

SPECIFIC EXAMPLE

In magnetic heat pumps it is often desired to circulate a cryogenic heat exchanger in a close loop. In traditional methods mechanical pumps are used and this results in major engineering problems particularly in the area of sealing the drive of such a pump. In the practice of the instant invention we are first converting the cryogenic liquid to a diamagnetic colloid by techniques described in a co-pending application entitled "Diamagnetic Colloids Containing Superconducting Particles".

A closed loop heat exchanger pipe 1" in diameter, is fit externally with a device as described in FIG. 1, about 3" long having 12 independently quenchable superconducting annuli. The superconductor is a 123 compound deposited by techniques described in a co-pending application entitled "Magnetic Flux Concentrators and Diffusers" except that a rotating mandrel is used as a substrate.

A magnetic field is created inside the solenoid by passing a current of about 1 ampere in the outer solenoid (about 200 turns). A configuration of quenched and unquenched annuli as described in FIG. 7 is generated by quenching the appropriate superconducting annuli, and this configuration is moved to the left by the sequential quenching and unquenching of appropriate annuli, to move the diamagnetic colloid to the left. In this specific example the current powering the solenoid is kept constant and the pumping rate is adjusted by accelerating or decelerating the quenching sequence.

It is understood that the above described embodiments of the invention are illustrative only and modifications and alterations thereof may occur to those skilled in the art. Accordingly, it is desired that this invention not be limited to the embodiments disclosed herein but is to be limited only as defined by the appended claims.

Figure 10:
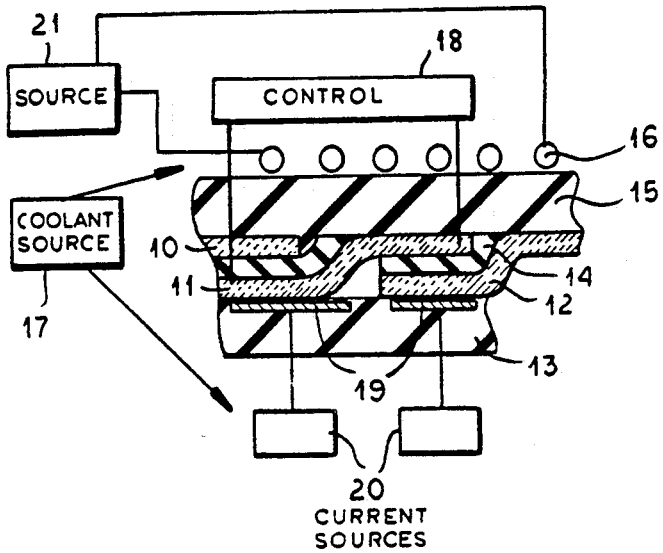

In FIG. 10, I have shown in section and in greater detail the relationship between successive annuluses.

As can be seen from FIG. 10, each annulus 10, 11, 12 surrounds the insulating tube 13 and partly overlaps the next annulus being separated by electrical insulation 14 therefrom. An outer layer of insulation 15 surrounds the annulus and the solenoid coil 16, in turn, spacedly surrounds the insulating sheath 15. A coolant source 17 can feed the coolant through the interior of the tube 13 and through the space between the solenoid coil 16 and the sheath 15 to bring the superconductor annuluses to a temperature below the critical temperature for superconductivity. Each annulus is connected to a controlled current source 18 adapted to turn on and off a quenching current through that annulus as described and thereby repeatedly swing the annulus between its nonsuperconductive and superconductive states. Each annulus, moreover, can be juxtaposed with a resistance heater 19, connected to respective current sources 20 so that the temperatures of the respective annuluses can be selectively brought to a level above the critical temperature alone, or in conjunction with the application of the quenching current.

In FIG. 10, as well, the source 21 for electrically energizing the solenoid 16 has been illustrated.

Figure 11:
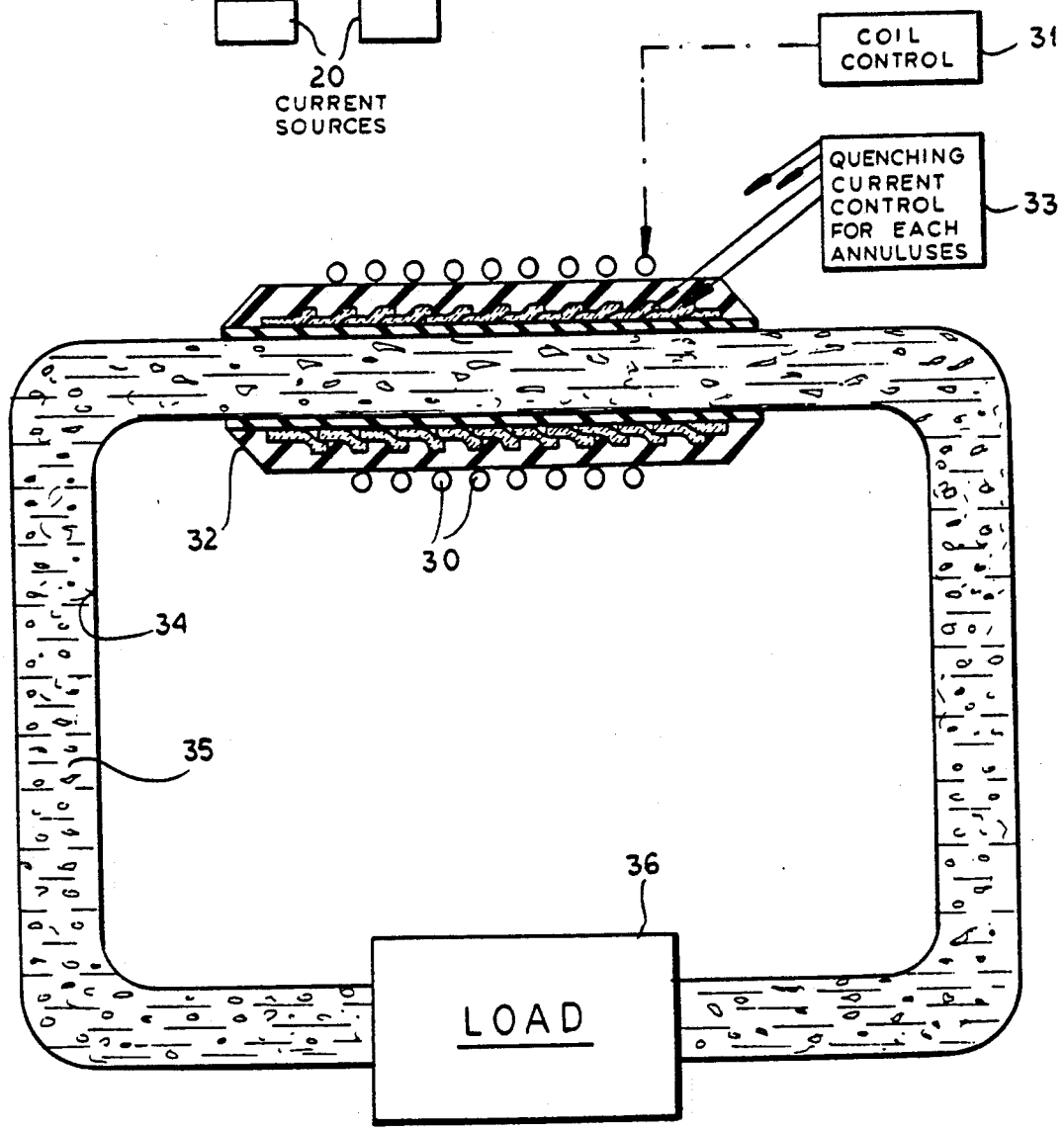

In FIG. 11, I have shown a pumping system in which the solenoid 30 energized by a source 31 surrounds a switchable superconductive assembly 32 of the type described in connection with FIGS. 1 and 10. The individual quenching currents are delivered at 33. As can be seen from FIG. 11, moreover, the device is provided along a closed circulating path 34 for a superconductive diamagnetic colloid 35 as described previously. A load, such as a superconductive apparatus to be cooled by circulation of the colloid therethrough has been represented at 36.

As the magnetic field is switched periodically in the pattern shown in FIGS. 5 and 7 to sweep the diamagnetic colloid through the array of annuluses, the colloid is pumped. In that case, of course, the dispersion of the colloid in the cryogenic coolant, such as liquid nitrogen, serves to cool the annuluses to superconductive temperatures.

I claim:

1. An apparatus for producing a topologically modifiable magnetic field, comprising:

a solenoid coil;

a multiplicity of superconducting annuluses disposed within said coil and axially spaced apart therein;

means for at least selectively cooling said annuluses to a temperature below the critical temperature for superconductivity of said annuluses;

means for electrically energizing said coil to produce a magnetic field; and means for selectively quenching superconductivity of said annuluses so that certain of said annuluses can be rendered nonsuperconductive while at least one of said annuluses is in a super conductive state to modify the topology of the magnetic field produced by said coil.

2. The apparatus defined in claim 1 wherein adjacent ones of said superconducting annuluses axially overlap one another but are electrically insulated from one another.

3. The apparatus defined in claim 1 wherein adjacent ones of said superconducting annuluses have edges which are over-lapped by auxiliary selectively quenchable superconductive annuluses but are electrically insulated therefrom.

4. The apparatus defined in claim 1 wherein said means for selectively quenching superconductivity of said annuluses includes a quenching current source connected individually to said annuluses for passing respective quenching currents therethrough exceeding respective critical currents of the superconductive annuluses.

5. The apparatus defined in claim 4 wherein said source is dimensioned to deliver to each annulus a quenching current exceeding the critical current of the superconductive annulus in the magnetic field applied by said coil.

6. The apparatus defined in claim 4 wherein said source is dimensioned to deliver to each annulus a quenching current exceeding the critical current of the superconductive annulus with no applied magnetic field.

7. The apparatus defined in claim 1 wherein said means for selectively quenching superconductivity of said annuluses includes means for individually raising the temperatures of said annuluses above the critical temperature of the respective superconductive annulus.

8. The apparatus defined in claim 7 wherein said means for raising temperature is dimensioned to raise the temperature of each annulus above the critical temperature thereof in the magnetic field applied by said coil.

9. The apparatus defined in claim 7 wherein said means for raising temperature is dimensioned to raise the temperature of each annulus above the critical temperature with no applied magnetic field.

10. The apparatus defined in claim 1 wherein said means for selectively quenching superconductivity of said annuluses includes a quenching current source connected individually to said annuluses for passing respective quenching currents therethrough and means for individually raising the temperatures of said annuluses whereby a combination of applied quenching current and increased temperature quenches superconductivity in the respective annulus in the presence of a magnetic field applied by said coil.

11. The apparatus defined in claim 1 wherein said means for selectively quenching superconductivity of said annuluses includes a quenching current source connected individually to said annuluses for passing respective quenching currents therethrough and means for individually raising the temperatures of said annuluses whereby a combination of applied quenching current and increased temperature quenches superconductivity in the respective annulus with no applied magnetic field.

12. The apparatus defined in claim 1 wherein a space is provided between said coil and said annuluses.

13. The apparatus defined in claim 12, further comprising means for passing a coolant through said space.

14. The apparatus defined in claim 1 wherein said means for at least selectively cooling said annuluses includes means for passing a coolant through said space for cooling said annuluses.

15. A method of producing a topologically modifiable magnetic field, comprising the steps of:

(a) electrically energizing a solenoid coil to produce a magnetic field;

(b) disposing within said solenoid coil and arrayed therealong, a multiplicity of axially spaced apart superconducting annuluses;

(c) cooling at least some of said annuluses to a temperature below the critical temperature for superconductivity of said annuluses;

(d) selectively quenching superconductivity of said annuluses so that certain of said annuluses can be rendered nonsuperconductive while at least one of said annuluses is in a super conductive state to modify the topology of the magnetic field produced by said coil.

16. The method defined in claim 15 wherein the quenching in step (d) is controlled so that consecutive groups of quenched and unquenched annuluses are formed along said array.

17. The method defined in claim 15 wherein the quenching in step (d) is periodically controlled so that in each group of unquenched annuluses the leftmost annulus is quenched and in each group of quenched annuluses the leftmost is rendered superconductive.

18. The method defined in claim 15 wherein the quenching in step (d) is periodically controlled so that in each group of unquenched annuluses the rightmost annulus is quenched and in each group of quenched annuluses the rightmost is rendered superconductive.

19. A pump for a diamagnetic colloid, comprising:

an insulating tube traversed by a flowable diamagnetic colloid; a solenoid coil surrounding said tube;;

a multiplicity of superconducting annuluses disposed within said coil, around said tube and axially spaced apart thereon;

means for cooling said annuluses to a temperature below the critical temperature for superconductivity of said annuluses;

means for electrically energizing said coil to produce a magnetic field; and means for selectively quenching superconductivity of said annuluses so that certain of said annuluses can be rendered nonsuperconductive while at least one of said annuluses is in a super conductive state to periodically modify the topology of the magnetic field produced by said coil and pump said diamagnetic colloid through said tube.

* * * * *